United States Patent [19]

Langguth

[11] 3,957,296

[45] May 18, 1976

[54] VACUUM MULTIPLIER

[75] Inventor: Arthur F. Langguth, San Diego, Calif.

[73] Assignee: The United States of America as represented by the Secretary of the Navy, Washington, D.C.

[22] Filed: May 5, 1975

[21] Appl. No.: 574,786

[52] U.S. Cl. ..... 294/66 R; 294/64 R; 294/86 R

[51] Int. Cl.[2] ..... B66C 1/02

[58] Field of Search ..... 294/64 R, 65, 66 R, 294/75, 83 R, 83 A, 83 AA, 86 R, 110 R; 24/211 N; 61/69 R, 69 A; 114/16.8, 50, 51; 214/650 SG; 248/362, 363; 269/21; 279/3

[56] References Cited

UNITED STATES PATENTS

| | | | |
|---|---|---|---|
| 1,294,103 | 2/1919 | Hitchcock | 294/64 R |
| 2,708,046 | 5/1955 | Cushman | 294/64 R X |
| 3,424,486 | 1/1969 | Corley | 294/64 R |
| 3,722,941 | 3/1973 | Seiple et al. | 294/66 R |
| 3,853,345 | 12/1974 | Miller | 294/64 R |

FOREIGN PATENTS OR APPLICATIONS

| | | | |
|---|---|---|---|
| 972,612 | 10/1964 | United Kingdom | 294/64 R |
| 219,144 | 8/1968 | U.S.S.R. | 294/64 R |
| 6,703,467 | 9/1968 | Netherlands | 294/64 R |

OTHER PUBLICATIONS

Western Electric Tech. Digest No. 22; Apr., 1971; "Vacuum Pickup Device" by McDaniel.

*Primary Examiner*—Evon C. Blunk
*Assistant Examiner*—Johnny D. Cherry
*Attorney, Agent, or Firm*—Richard S. Sciascia; Ervin F. Johnston; Thomas Glenn Keough

[57] ABSTRACT

This apparatus securely interconnects a line or an instrumentation package to a rigid surface underwater. A suction cup member has a lip which pliably accommodates the surface and allows a trigger mechanism to be brought in contact with the surface. The trigger mechanism releases a coiled helical biasing spring which distends an essentially cylindrically shaped bellows to create a multiplied suction or a vacuum inside the suction cup. The multiplied suction holds the apparatus and instrumentation package or line securely on the surface. Because of its straightforward design and uncomplicated mode of operation, it is fully capable of being deployed by marine mammals. Having the suction cup and bellows integrally molded reduces the possibility of leaking and enhances reliability.

9 Claims, 7 Drawing Figures

VACUUM MULTIPLIER

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

Devices for securing a line or an instrumentation package onto a surface underwater have existed in one form or another for a number of years. Recovery of an underwater object or a long term monitoring of some undersea phenomena requires that the interconnection be fast and, particularly with respect to the attachment of scientific instrumentation, lasting. Explosive stud-gum like devices generally provide fast and lasting connection, yet the concussion created as the studs are being embedded can adversely affect a diver's hearing and, of course, the stud's penetration damages the supporting surface. Magnets have been used with varying degrees of success and they are quite reliable when attached to a magnetic surface. However, magnetic connectors tend to be heavy and they are useless for attachment to non-magnetic surfaces. A more acceptable connector is a recently developed tripod shaped framework having large rigid discs on the bottoms of its legs. A large O-ring is mounted on the underside of the discs and a vacuum pump evacuates a chamber formed between the disc, the O-ring and the surface. It has been aptly demonstrated that this tripod arrangement securely holds a camera carried on the outer hull of a submersible. At moderate speeds the tripod held the camera firmly and the films indicated that there was no fluttering by the camera. The main drawbacks of the tripod arrangement are its large size and the fact that the discs would maintain a vacuum and hold only when the mounting surface was smooth and free from surface irregularities. Simple suction cups molded from a resilient compound, such as rubber, have been found to work to an acceptable degree under certain conditions. On the positive side, they are small enough to be easily emplaced and their compliant lips maintain a vacuum on a slightly irregular surface. However, these suction cups usually do not create a sufficient internal vacuum to hold heavy instrumentation packages or to resist strong tensile forces. Thus, there is a continuing need in the state of the art for a device which reliably interconnects an instrumentation package or a line onto a metallic or non-metallic surface and which creates a sufficient internal vacuum to permit long term interconnection on the surface.

SUMMARY OF THE INVENTION

The present invention is directed to providing an apparatus for securing a line or an instrumentation package to an underwater surface. An elongate, flexible bellows closed at one end is integrally connected to a means for pliably accommodating the surface in a sealed relationship. A helical biasing spring carried inside the bellows is released to enlarge the bellows when a triggering mechanism contacts the surface. Since the apparatus has already been placed in a sealed relationship the enlarging of the cavity increases the suction or vacuum and more securely holds the apparatus on the surface.

It is a prime object of this invention to provide a more reliable securing device.

Another object of the invention is to provide a vacuum securing device having a magnified self-created vacuum.

Yet another object is to provide a device cocked before deployment to enable an immediate secure interconnection underwater.

Still another object is to provide an apparatus employing an integrally connected bellows and suction cup to prevent leaking and thereby enhance reliability.

A further object is to provide an underwater attachment which is capable of being deployed by marine mammals.

A further object is to provide an underwater interconnector having its trigger mechanism coaxially aligned to initiate actuation of the vacuum multiplier only after a suction cup has been mounted in a sealed relationship.

These and other objects of the invention will become more readily apparent from the ensuing specification when taken with the drawings.

DESCRIPTION OF THE PREFERRED EMBODIMENT

Figure 1:
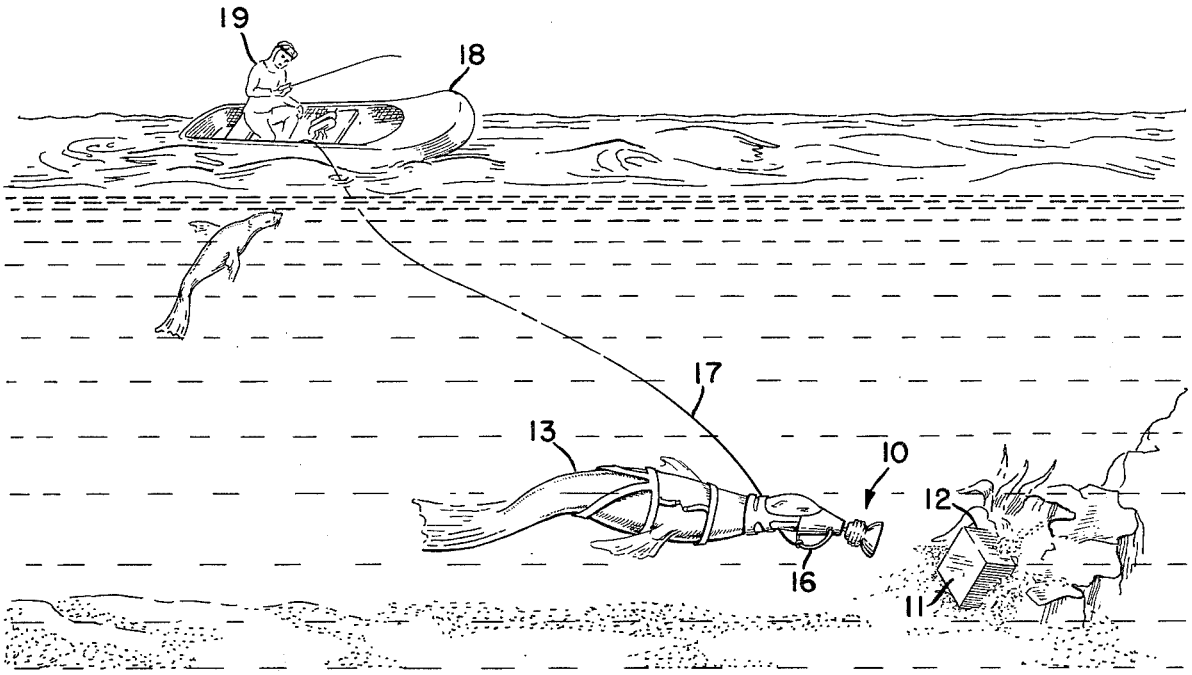
FIG. 1 isometrically portrays the invention being used by a marine mammal to retrieve an instrumentation package.
Figure 2:
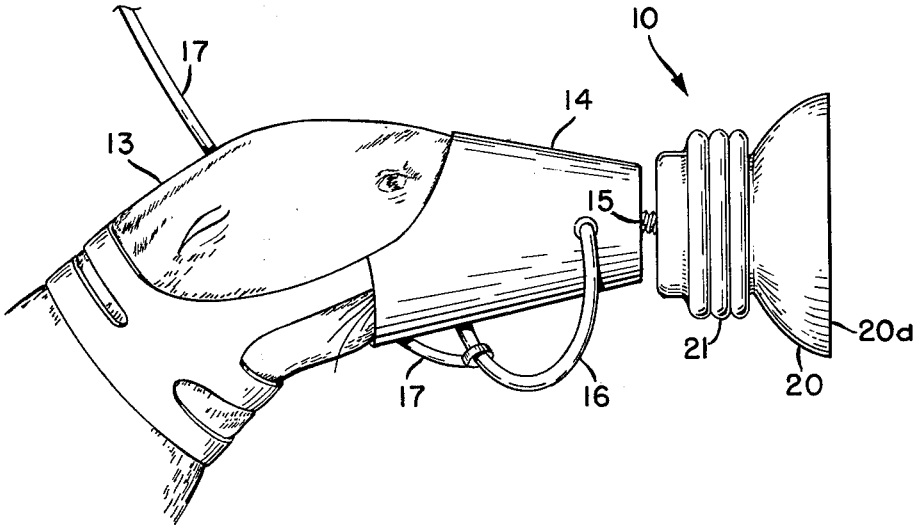
FIG. 2 shows the invention as it is mounted on a marine mammal nose cup.

Referring now to FIG. 1 of the drawings, there is shown a vacuum multiplier attachment apparatus 10 about to make a secure interconnection on a surface 11 of an electronics package 12.

Due to the invention's straightforward design, such interconnections are routinely made by a sea lion 13 fitted with a nose cup 14. The nose cup has a threaded bore, not shown, for receiving an appropriately threaded bolt 15 extending from the attachment apparatus. A ring 16 is journaled in the nose cup to serve an an anchor point for a messenger line 17 played out from a surfaced craft 18. The ring also aids animal handlers 19 when the nose cup and attachment apparatus are fitted over the marine mammal's mouth and nose.

After the attachment apparatus is affixed on the electronics package, the animal need only pull back its head to disengage itself from the nose cup and attachment apparatus. The animal ascends to the surface and a messenger line now reaches from the package for guiding a heavy duty hoisting apparatus or divers for recovery. Of course, if the package to be retrieved is not excessively heavy, the line itself is used to bring the package to the surface for the attachment apparatus holds fast and is difficult to disengage.

The two portions of the inventions which ensure responsive operation of the invention are a cup shaped portion 20 and an essentially cylindrically shaped bellows portion 21. The bellows portion is closed at one end 22 while its opposite end or mouth 23 is joined to the cup shaped portion.

One of the factors contributing significantly to the reliability of the instant invention is that the cup shaped portion, bellows portion and end portion are integrally molded from a compliant material such as rubber. Thusly fabricated there are no seams, holes or other lines of juncture through which ambient water could leak to destroy the internal vacuum created. A lip 20*a* of the cup shaped portion has a tapered rounded surface and because it is also made from the compliant rubber material, it accommodates small irregularities on surface 11. As the vacuum assist is applied it further deforms to further accommodate these irregularities, as will be explained below.

Figure 3:
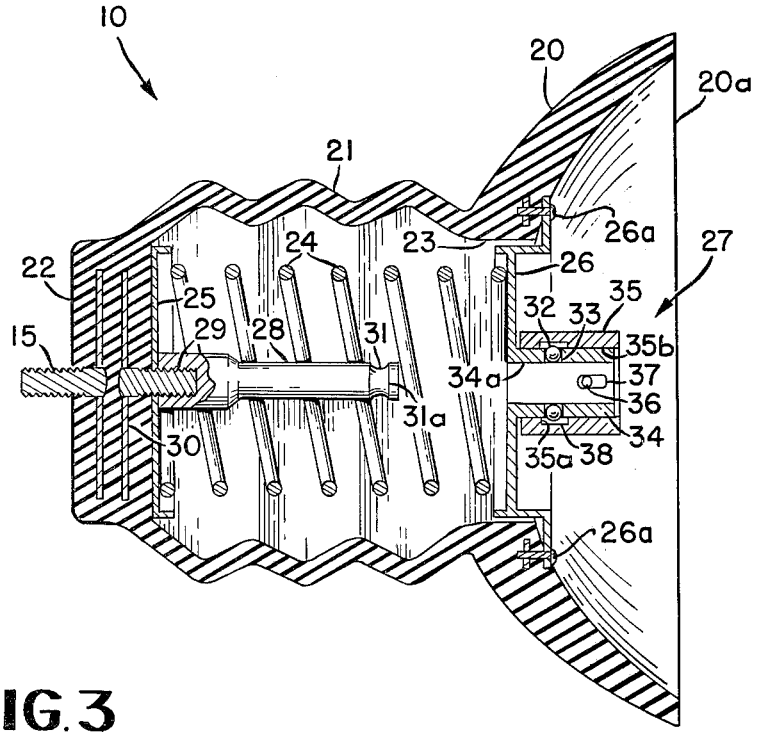
FIG. 3 shows a longitudinal cross-sectional representation of the invention in the extended position.

Looking more particularly to FIG. 3, the invention is shown in its uncocked position with bellow portion 21 being fully extended by a helical biasing spring 24. The spring exerts an opposed force on a plate 25 carried on the inside of end portion 22 and a bracket 26 mounted in mouth 23 of the bellows. The plate serves to distribute the force of the spring against the compliant end portion and the bracket distributes the spring's force via a number of circumferentially disposed bolt-and-bearing-plate combinations 26*a*, only two of which are shown. The bracket is provided with sufficient openings, not shown, to allow the transfer of an increased vacuum or suction from the bellows portion to the cup shaped portion.

With the elements described above, the invention is predisposed to maintain the general configuration depicted in FIG. 3. However, by the inclusion of a trigger mechanism 27, the biasing force of the helical spring is arrested until needed to create a multipled vacuum within the bellows and cup shaped portion. The trigger mechanism includes a stem portion 28 secured to a threaded projection 29 and a disc shaped member 30. The disc shaped member and threaded projection are potted in end portion 22 along with a similarly shaped disc attached to threaded bolt 15. Note that these elements are potted in the end portion in such a manner so as to prevent the creation of any pathways from the outside of the vacuum multiplier to its inside.

An annular groove 31 is machined at the opposite end of the stem portion to engage a plurality of bearings or steel balls 32 contained in a number of recesses 33. The recesses are provided in the walls of a tubularly shaped axial projection 34 of bracket 26. The recesses are dimensioned to permit only a portion of the bearings to extend into an axial bore 34*a*. The bore is sized to allow reciprocal travel of stem portion 28 while the recesses restrain the bearings from falling into the bore when the stem portion is withdrawn.

Radially outwardly, a sleeve 35 is sized to reciprocally fit over the axial projection and has at least one spur 36. Each spur fits into a slot 37 provided in axial projection 34 to limit the distance of reciprocal travel by the sleeve.

An annular slot 38 is cut into the inner surface of sleeve 35 to receive bearings 32 when the sleeve 35 is positioned to radially align the slot with the bearings. When the slot and bearings are so aligned, the bearings can be moved out of axial bore 34*a* to allow cocking or release of stem portion 28.

The mechanical coaction of the aforedescribed elements ensure positive interconnection to a rigid surface. As a matter of fact, the reliability of this invention is of such a high degree as to allow the attachment of a line to a submerged package by trained marine mammals 13. A nose cup 14 is fitted over the mammal's nose and via threaded bolt 15, the vacuum attachment apparatus or multiplier 10 is connected. However, prior to connecting the attachment apparatus to the nose cone, it must be cocked.

Figure 4:
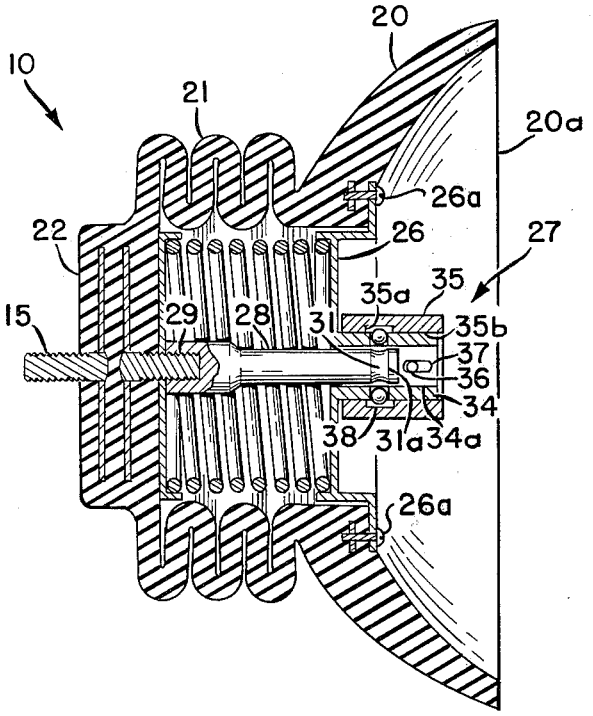
FIG. 4 depicts the invention in a first stage of the cocking operation.

FIG. 3 shows the invention in an uncocked, extended state. Grasping the attachment apparatus at one end portion 22 and on bracket 26 and exerting a force toward each other, causes stem portion 28 to move into axial bore 34*a* of trigger mechanism 27. The stem portion is brought to a position in the trigger mechanism where the bearings 32 are radially aligned with annular recess 31, see FIG. 4.

Figure 5:
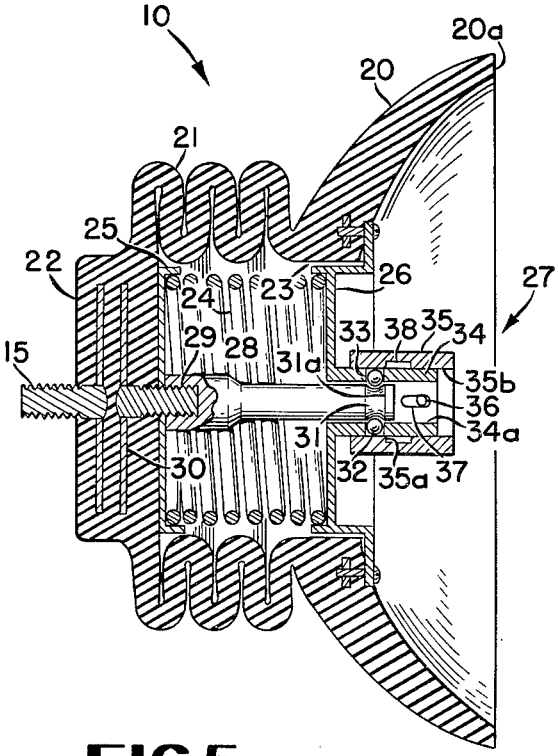
FIG. 5 shows the invention cocked.

Cocking of the trigger mechanism to hold the attachment apparatus in this position is a relatively simple matter, for all that is involved is merely axially displacing sleeve 35 outwardly from bracket 26. As the sleeve is being displaced, a shoulder 35*a* of annular slot 38 cams bearings 32 out of the annular slot and into annular groove 31 of stem portion 28. Meanwhile, spur 36, in addition to retaining the sleeve on the tubular axial projection, limits how far the sleeve travels, so that an inner annular surface 35*b* holds the bearings in annular groove 31, see FIG. 5.

Thus, by appropriately locating the stem portion and sliding the sleeve to the right, the attachment apparatus is cocked. In this position, bellows 21 is compressed in an overlapping relationship and helical spring 24 is compressed to nearly its limit.

To actuate the attachment apparatus, the marine mammal places lips 20*a* of cup shaped portion 20 against surface 11. A further pushing in on the apparatus by the animal buckles the resilient walls of the cup shaped portion and brings the end of sleeve 35 to bear against surface 11.

Figure 6:
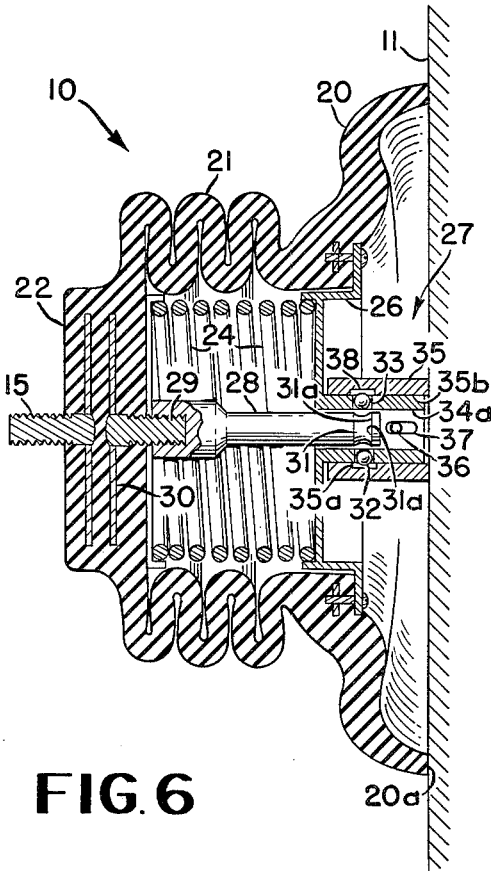
FIG. 6 is the invention as it contacts a surface and the trigger mechanism releases the spring biased bellows.

An additional shove by the marine mammal holds sleeve 35 motionless with respect to surface 11 while the other elements of the attachment apparatus continue to move toward the surface. Once again, annular slot 38 is in radial alignment with the bearings, see FIG. 6.

Figure 7:
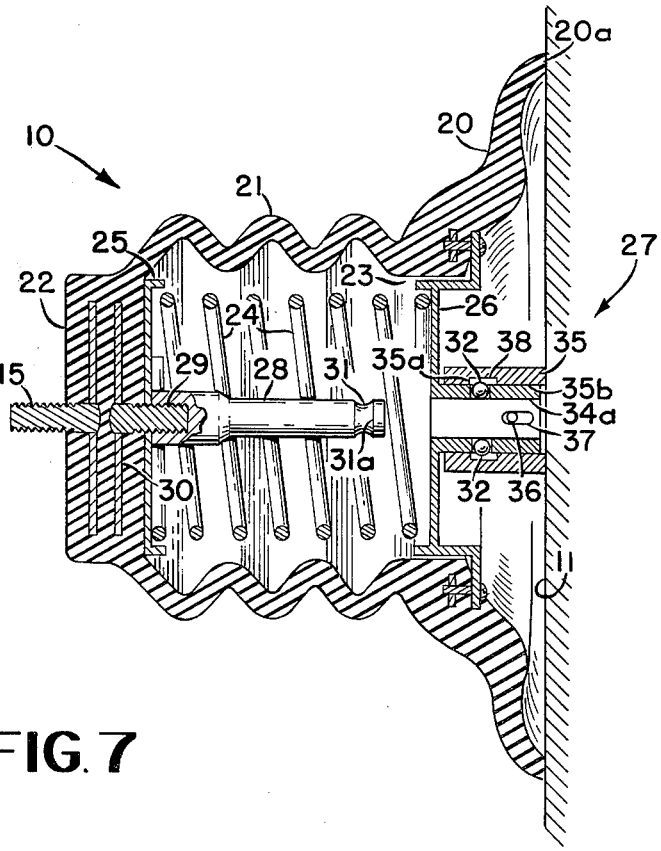
FIG. 7 shows the bellows extended by the biasing spring to create an increased internal vacuum.

At this point in time, actuation of the apparatus occurs. Biasing spring 24 urges the stem portion away from surface 11. As the stem is pulled from the trigger mechanism, shoulders 31*a* of annular groove 31 cam the bearings out of the annular groove and into annular slot 38. The attachment apparatus assumes the shape depicted in FIG. 7 with stem portion 28 totally withdrawn from axial bore 34*a* and lips 20*a* of cup shaped portion 20 fully engaging surface 11 in a sealed relationship.

Although this disclosed invention has concerned itself with undersea operation, it functions satisfactorily out of water. The ease at which it is operated attests to its superior engineering. The fact that trained animals can place and reliably actuate this device further emphasizes it as being a significant advance over the state of the art.

Obviously, many modifications and variations of the present invention are possible in the light of the above teachings, and, it is therefore understood that within the scope of the disclosed inventive concept, the invention may be practiced otherwise than as specifically described.

What is claimed is:

1. An apparatus for securing a line to a surface comprising:

means for flexibly enclosing a cavity having a mouth communicating therewith;

means carried on the mouth of said cavity for pliably accommodating said surface in a sealed relationship;

means carried in the cavity for urging the flexibly enclosing means to enlarge said cavity;

means holding the urging means for releasing the urging means and enlarging said cavity when said surface is contacted and the releasing means is displaced thereby to pull the pliably accommodating means against said surface thereby securing the line thereto;

means mounted on the flexibly enclosing means for forcing the pliably accomodating means against said surface and displacing the releasing means; and means reaching across the mouth of said cavity for positioning the releasing means with respect to the pliably accommodating means to ensure the displacement of the releasing means after the pliably accommodating means has contacted said surface.

2. An apparatus according to claim 1 in which the flexibly enclosing means is a cylindrically shaped bellows closed at one end, the forcing means is mounted at the closed end and the releasing means is coaxially disposed with respect to the bellows and forcing means to ensure the responsive displacement of the releasing means after the pliably accommodating means has contacted said surface.

3. An apparatus according to claim 2 in which the urging means is a helical biasing spring held between the closed end of the bellows and the positioning means.

4. An apparatus according to claim 3 in which the pliably accommodating means is a lip flaring conically outwardly from the mouth of said cavity and the position means is a bracket secured around the mouth of said cavity.

5. An apparatus according to claim 4 in which the releasing means includes a stem portion connected at one end to the closed end of the bellows and a ball detent mechanism carried on the bracket for engaging the opposite end of the stem portion.

6. An apparatus according to claim 5 in which the ball detent mechanism includes a tubularly shaped member coaxially disposed with respect to the bellows and connected to the bracket and at least one ball member is carried in and at least one recess provided in the tubularly shaped member.

7. An apparatus according to claim 6 in which an annular groove is provided on said opposite end of said stem portion for being releaseably engaged by at least one said ball when said opposite end is appropriately disposed within said tubularly shaped member.

8. An apparatus according to claim 7 in which the ball detent mechanism further includes a sleeve provided with an annular slot at one end for receiving at least one said ball when the sleeve has been displaced by its opposite end's contacting said surface.

9. An apparatus according to claim 8 in which the bellows and lip are integrally molded from a compliant material to enhance reliability and the forcing means is configured to engage the nose cup of a marine mammal to allow attachment of the line to an underwater object.

* * * * *